US005782052A

United States Patent [19]

Lacy

[11] Patent Number: 5,782,052

[45] Date of Patent: Jul. 21, 1998

[54] OMAMENTAL SHUTTER

[75] Inventor: Michael A. Lacy, Conyers, Ga.

[73] Assignee: Vantage Products Corporation, Conyers, Ga.

[21] Appl. No.: 858,232

[22] Filed: May 19, 1997

Related U.S. Application Data

[60] Provisional application No. 60/018,043 May 21, 1996.

[51] Int. Cl. [6] ..... E06B 7/08

[52] U.S. Cl. ..... 52/473; 52/455; 52/458

[58] Field of Search ..... 52/455, 458, 473

[56] References Cited

U.S. PATENT DOCUMENTS

| | | |
|---|---|---|
| 2,596,569 | 5/1952 | Leigh . |
| 3,055,467 | 9/1962 | Peek et al. . |
| 3,191,242 | 6/1965 | Rauen . |
| 3,336,715 | 8/1967 | Savary . |
| 3,341,994 | 9/1967 | Olson . |
| 3,364,643 | 1/1968 | Smith et al. . |
| 3,455,079 | 7/1969 | Frederick . |
| 3,461,629 | 8/1969 | Smith . |
| 3,548,555 | 1/1969 | Trostle et al. . |
| 3,584,427 | 6/1971 | Johnston . |
| 3,638,383 | 2/1972 | Ribas . |
| 3,782,051 | 1/1974 | Quinif . |
| 3,797,186 | 3/1974 | Smith . |
| 3,810,338 | 5/1974 | Wolfert . |
| 3,932,959 | 1/1976 | Jansons et al. . |
| 4,020,609 | 5/1977 | Daniels . |
| 4,023,320 | 5/1977 | Jackson . |
| 4,251,966 | 2/1981 | Foltman . |
| 4,381,633 | 5/1983 | MacLeod . |
| 4,765,110 | 8/1988 | MacaLeod . |
| 4,858,400 | 8/1989 | Foyt . |
| 5,060,442 | 10/1991 | Chubb ..... 52/473 |
| 5,152,116 | 10/1992 | MacGowan . |
| 5,265,391 | 11/1993 | Ricard et al. . |
| 5,347,782 | 9/1994 | Vagedes . |
| 5,373,677 | 12/1994 | Vagedes . |
| 5,430,986 | 7/1995 | Vagedes . |
| 5,634,998 | 6/1997 | Schiedegger et al. . |
| 5,704,182 | 1/1998 | Schiedegger . |

FOREIGN PATENT DOCUMENTS

| | | |
|---|---|---|
| 53-30147 | 3/1978 | Japan . |

*Primary Examiner*—Christopher Kent
*Attorney, Agent, or Firm*—Seidel Gonda Lavorgna & Monaco

[57] ABSTRACT

A shutter assembly is provided which includes an integral shutter body portion having side rails and either slats or raised panels there between. The shutter assembly also includes separately molded end caps and one or more mullions. The shutter body is adjusted to its desired length by cutting the shutter at one or both ends. The end caps are snapped onto the shutter body and/or welded into place. The mullion is then snapped onto the body to produce a finished, balanced appearance for the overall shutter assembly.

20 Claims, 8 Drawing Sheets

FIG. 1
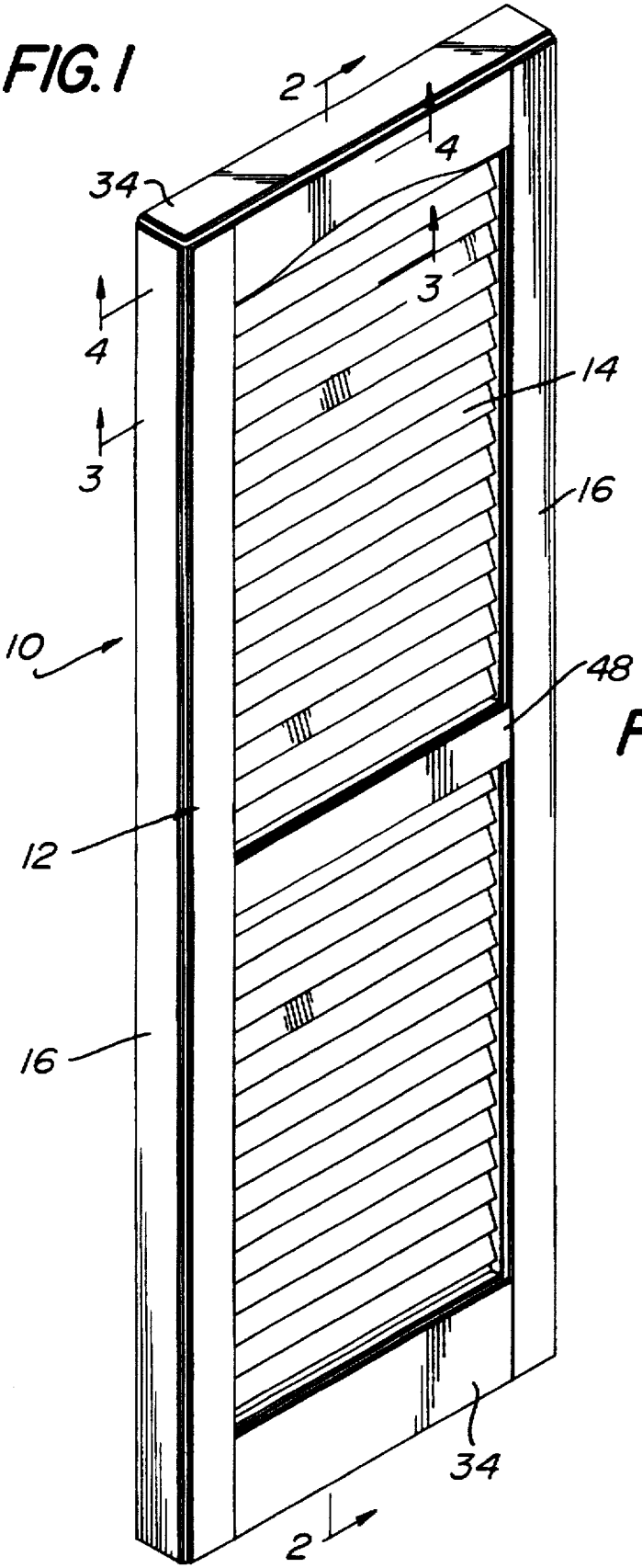
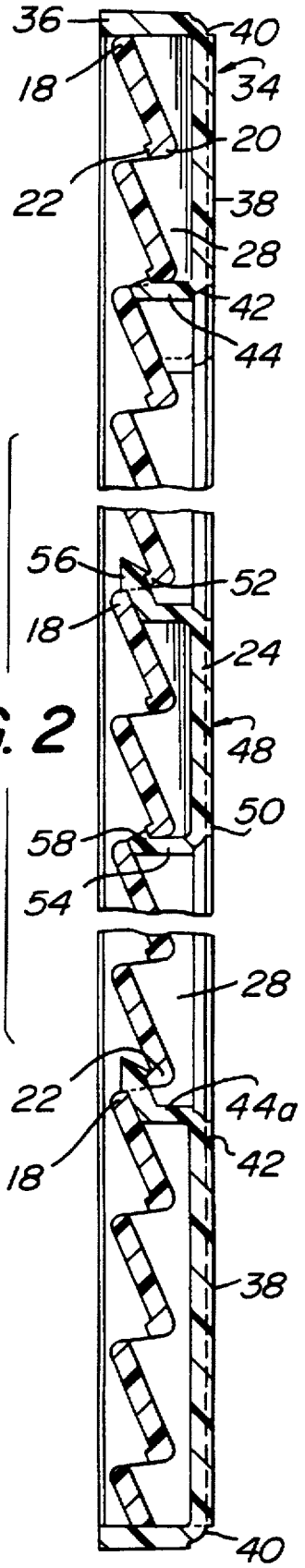
FIG. 2

FIG. 10
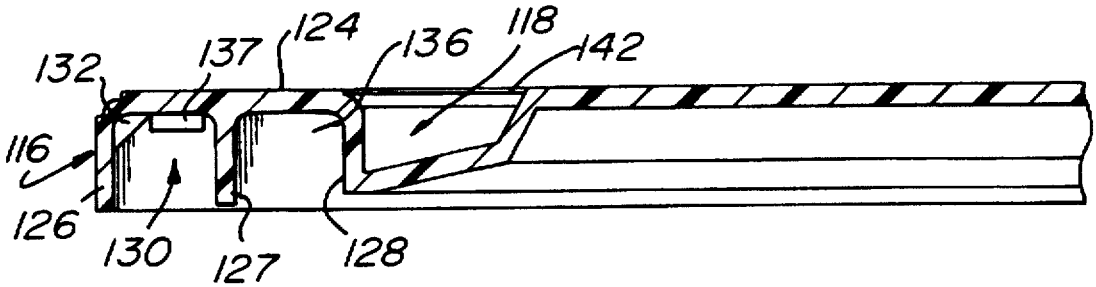
FIG. 11
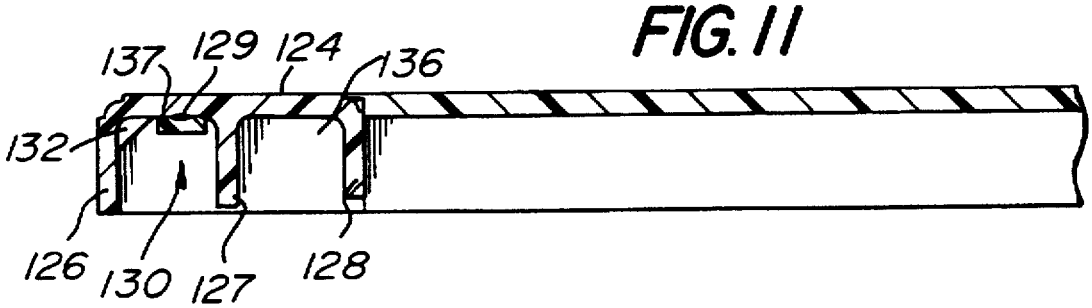
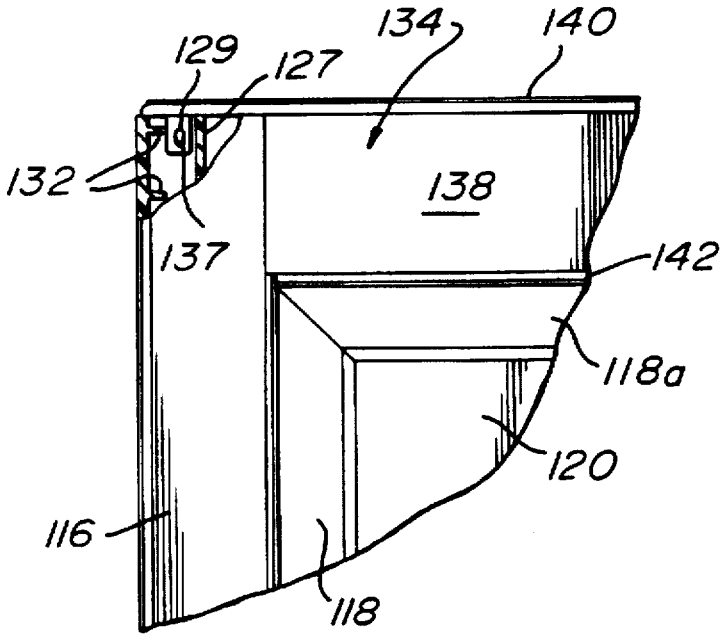
FIG. 12

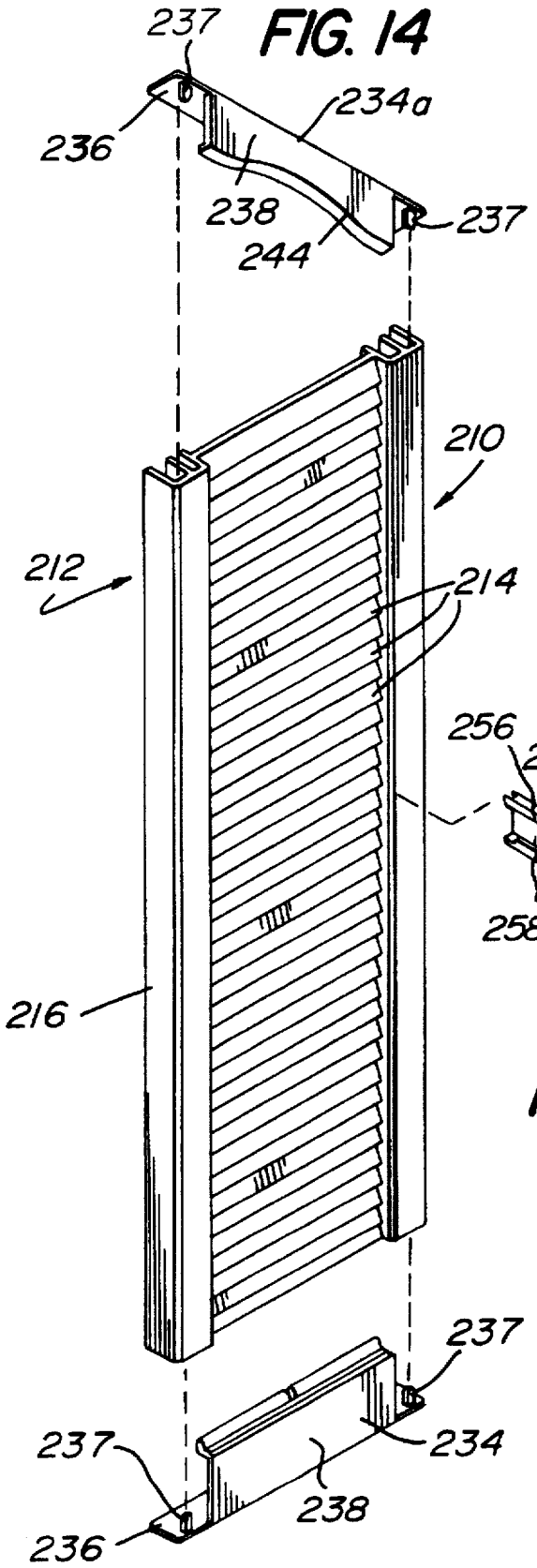
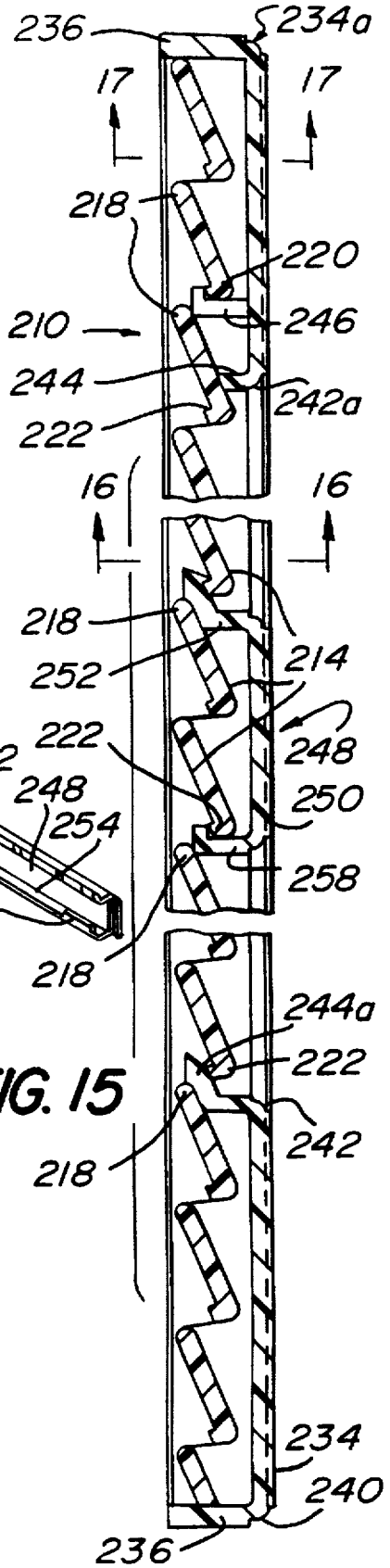
FIG. 15

FIG. 16
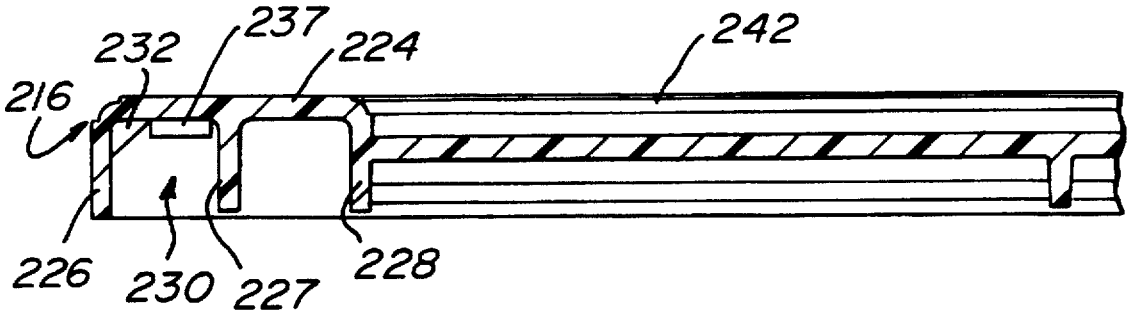
FIG. 17
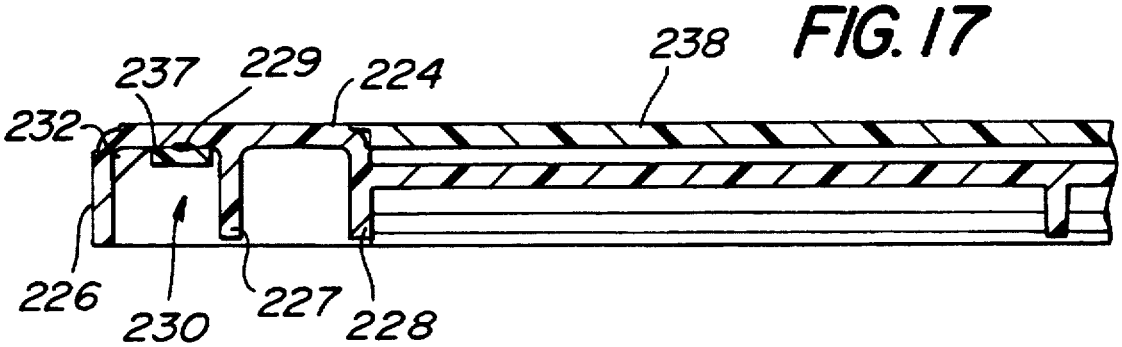
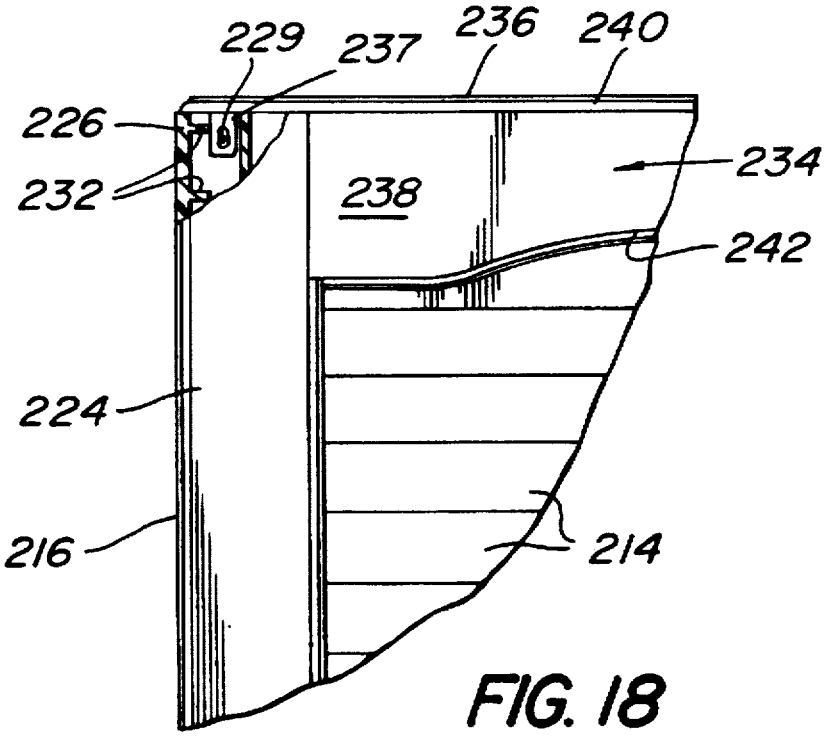
FIG. 18

OMAMENTAL SHUTTER

FIELD OF THE INVENTION

The present invention relates to a shutter assembly having a body molded of a single piece of plastic containing side rails and slats or raised panels. The shutter is also provided with end caps and a mullion which can be positioned after the shutter body has been adjusted to a desired length.

BACKGROUND OF THE INVENTION

It is known to have shutter assemblies for decorative use in constructing homes which are adjustable in length. Many of these existing adjustable shutters have a plurality of parts that must be assembled at the job site. These known shutters typically require complex cutting or trimming operations in order to adjust the length of the shutter.

It is also known to have adjustable shutters having a single-piece body that contains a permanent central mullion. However, at least two cuts are needed for such single-piece shutters in order to adjust the length and present a balanced appearance. Because of this two cut assembly procedure, the end caps cover the side rail portions of the shutter body. Further, the line where the end caps cover the body can be detected once the shutter has been assembled. Further, these shutters are held together by screws, therefore increasing the time and effort needed to assemble the shutter.

Thus, there exists a need for a shutter assembly that is easy to size and assemble. There also exists the need for a shutter which presents a finished and balanced appearance once it has been assembled.

SUMMARY OF THE INVENTION

The present invention is directed to an ornamental shutter having a single-piece body portion, typically made of molded plastic. The body of the shutter includes a plurality of horizontal slats which extend between and are integrally formed with two side rails. Alternatively, the body of the shutter may include two or more raised panels between the side rails. Each side rail contains a channel having horizontally extending tabs therein. End caps are provided having an end wall for covering the end of the shutter body and a front panel extending across at least a portion of the end of the shutter body. Flanges are provided on the end caps which are adapted to engage the tabs located within channels within the side rails. Alternatively, the flanges on the end caps may be welded to the shutter body to secure the end caps in position. A detachable mullion is engaged on the horizontal slats or between the raised panels. The mullion is adjustably positionable so that it may be centered with respect to the end caps. Various forms of attaching the mullion to the slats of the shutter body and/or the end caps to slats are contemplated. The adjustability of the mullion accounts for the changes in the overall length of the shutter when cut to size and provides the desired final appearance.

BRIEF DESCRIPTION OF THE DRAWINGS

For the purpose of illustrating the invention, there is shown in the drawings various forms which are presently preferred; it being understood, however, that this invention is not limited to the precise arrangements and instrumentalities shown.

FIG. 1 shows perspective view of an open louvered shutter made in accordance with the present invention.

FIG. 2 shows a cross sectional view of the shutter taken along line 2—2 in FIG. 1.

FIG. 10 shows a cross sectional view of the shutter taken along line 10—10 in FIG. 8.

FIG. 11 shows a cross sectional view of the shutter taken along line 11—11 in FIG. 8.

FIG. 12 shows an enlarged fragmentary view of the edge of the shutter of FIG. 8.

FIG. 14 shows an exploded perspective view of an alternate shutter embodiment.

FIG. 15 shows a cross sectional view of the shutter embodiment of FIG. 14.

FIG. 16 shows a cross sectional view of the shutter embodiment taken along line 16—16 in FIG. 15.

FIG. 17 shows a cross sectional view of the shutter embodiment taken along line 17—17 in FIG. 15.

FIG. 18 shows an enlarged fragmentary view of the edge of the shutter embodiment of FIG. 15.

DETAILED DESCRIPTION OF THE DRAWINGS

Figure 3:
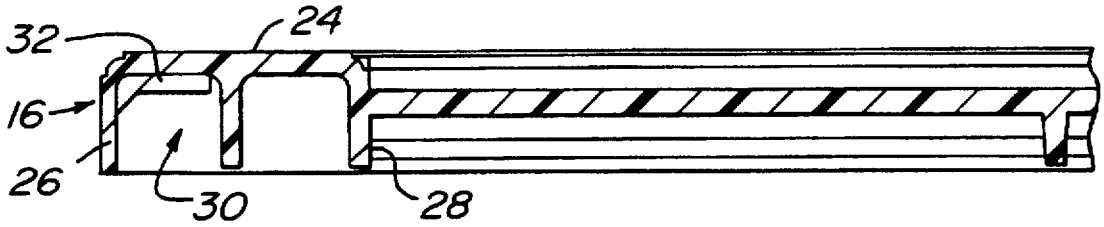
FIG. 3 shows a cross sectional view of the shutter taken along line 3—3 in FIG. 1.

Referring to the drawings, wherein like numerals refer to like elements, there is shown in FIG. 1 a shutter which is generally referred to by the numeral 10. The shutter 10 as illustrated is known as an open louvered type shutter and generally comprises a body portion 12 having a plurality of evenly spaced horizontal slats 14. The slats 14 are disposed between and generally integrally formed with two side rails 16.

As shown in cross section in FIG. 2, each slat 14 is angled with a first edge 18 positioned adjacent the rear of the shutter and a second edge 20 positioned forward of the first edge 18. A space is defined between the first edge 18 and the second edge 20 of adjacent slats 14. The second edge 20 includes a lip 22 which extends toward the rear of the shutter 10. The side rails 16 comprise a front wall 24, a side wall 26 and an inner wall 28. A channel 30 is formed behind the front wall 24. Within the channel 30 is formed a series of tabs 32.

Figure 4:
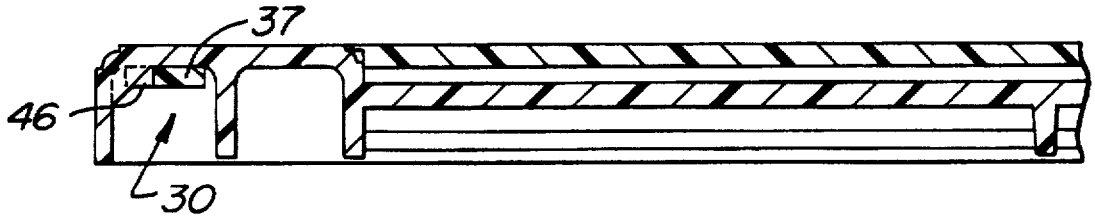
FIG. 4 shows a cross sectional view of the shutter taken along line 4—4 in FIG. 1.
Figure 5:
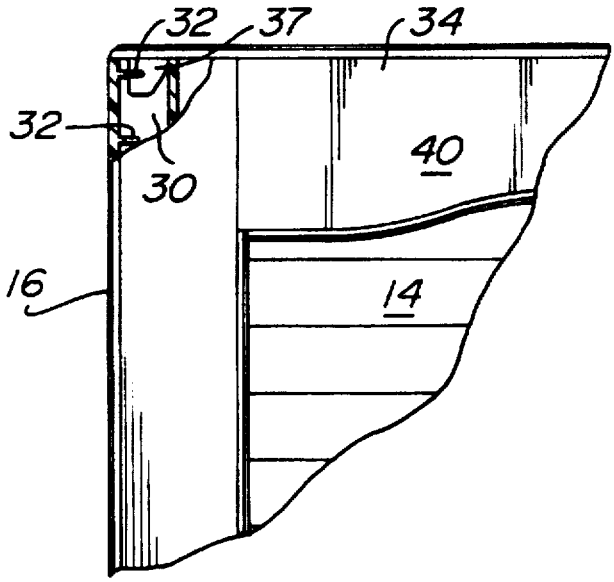
FIG. 5 shows an enlarged fragmentary view of the edge of the shutter of FIG. 1.

As shown in FIGS. 3–5, end caps 34 are provided on each end of the shutter body 12. The end caps 34 include an end wall 36 having flanges 37 projecting downwardly therefrom. The end caps 34 further include a front panel 38 including a first edge 40 which is integrally formed with or attached to the end wall 36. A second edge 42 is formed at the opposite end of the front panel 38 from the first edge 40. A fin 44 is provided on the rear surface of the front panel 38. The fin 44 is adapted to engage the lip 22 extending rearwardly from the second edge 22 of each slat 14 so as to secure the second edge 42 of the end cap 34 to the front surface of the shutter body 12. As illustrated, the fin 44 on the upper end cap engages the rear surface of the lip 22. The fin **44*a* on the bottom end cap includes a pointed projection which engages the top of lip 22 as well as the top edge 18** of the slat there below.

When the end caps 34 are attached to the shutter body 12, the front panel 38 covers a plurality of slats 14 adjacent the ends of the shutter 10. When the fin 44 is snapped into the body 12 of the shutter 10, between adjacent slats 14, the end wall 36 is flush with the ends of the shutter body 12. Also, the front panel 38 of the end cap 34 lies substantially flush with the front wall 24 of the side rails 16. The flanges 37 include a notch 46 which is adapted to mate with the tabs 32 located within the channel 30 of each side rail 16. This engagement further secures the end caps 34 to the body 12 of the shutter 10.

Figure 7:
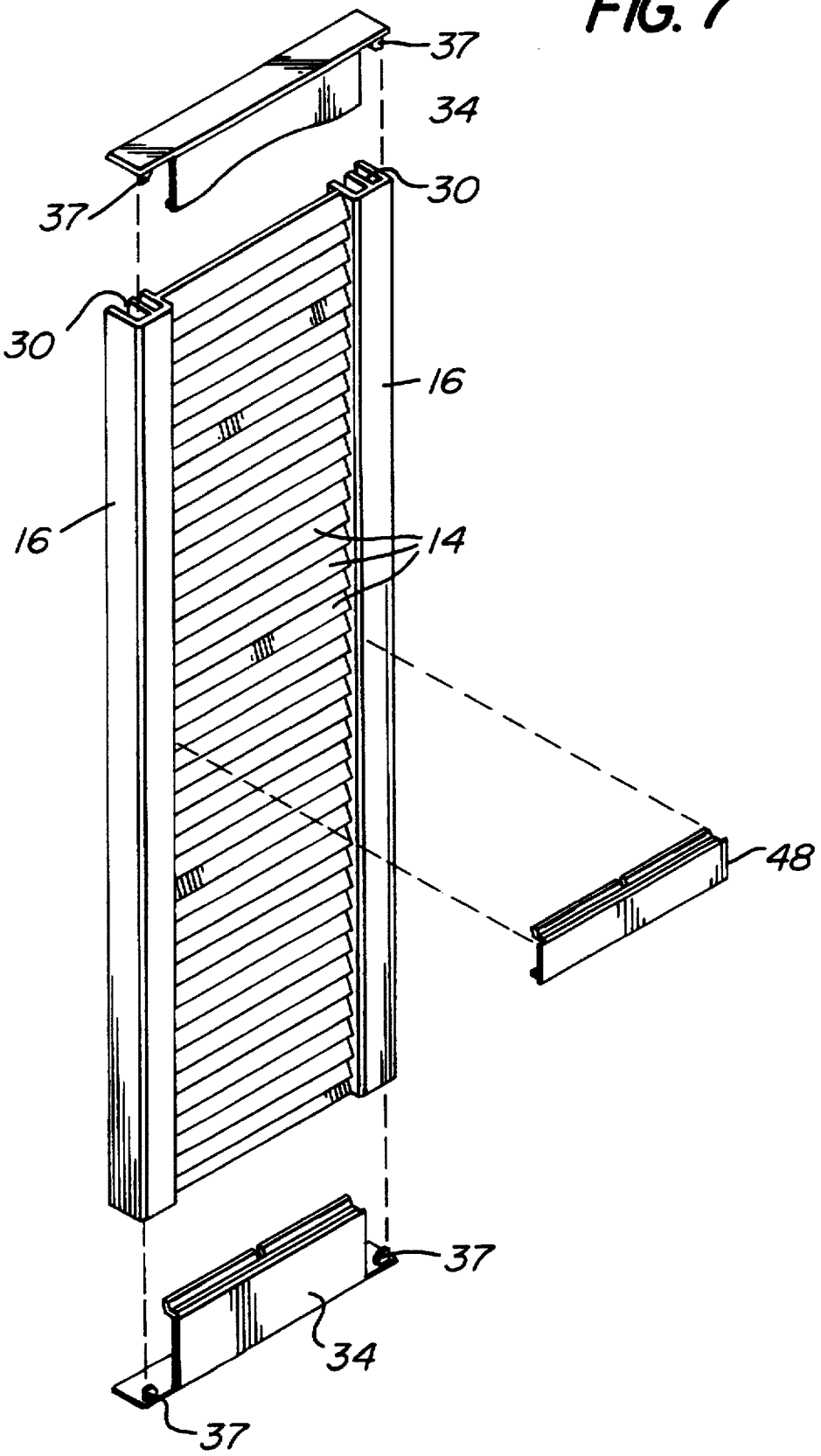
FIG. 7 shows an Exploded perspective view of the shutter of the present invention.
Figure 8:
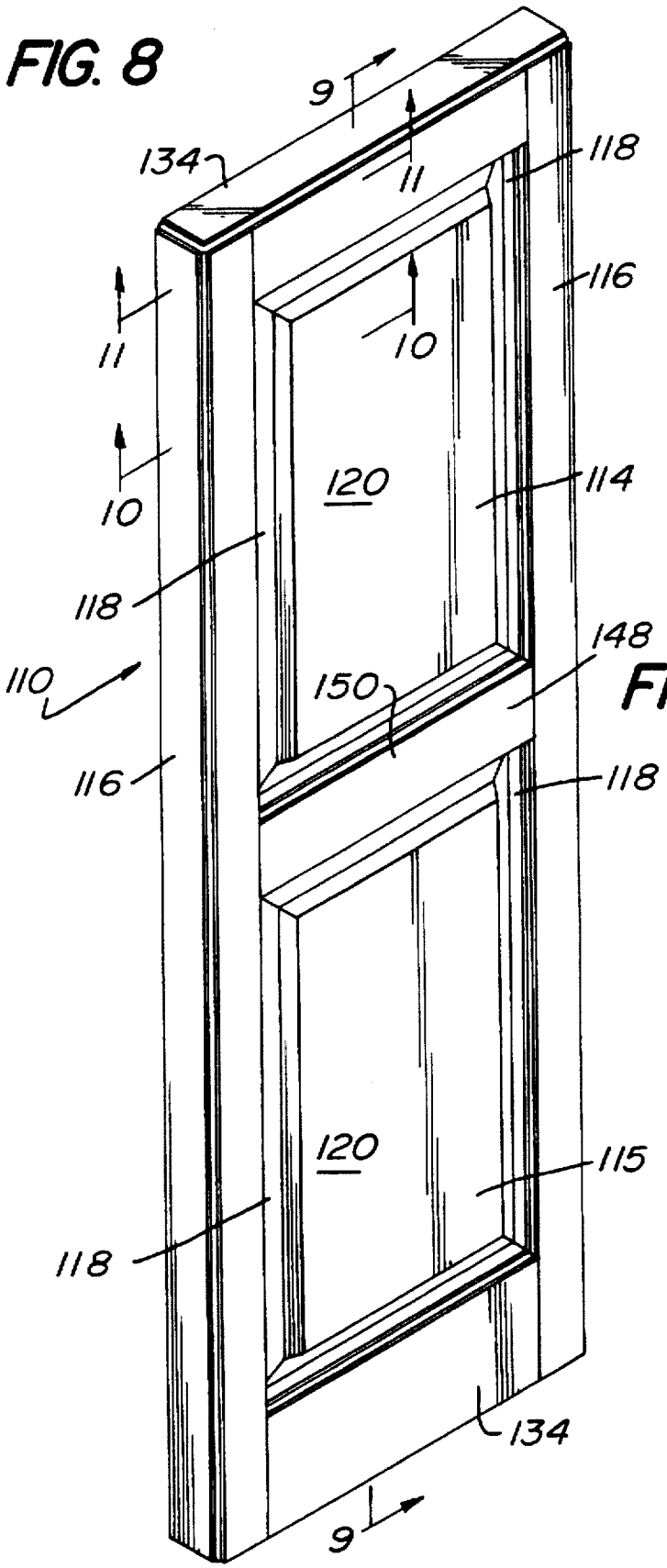
FIG. 8 shows perspective view of a raised panel shutter embodiment in accordance with the present invention.

As particularly shown in FIGS. 2 and 7, a mullion 48 is provided having a front wall 50 and first and second rearwardly projecting flanges 52, 54. The first flange 52 has a lip 56 which is adapted to be inserted behind and engaged by the lip 22 on the second edge 20 of one of the horizontal slats 14. As illustrated, the lip 56 of the first flange 52 includes a pointed projection which engages with the top of the lip 22 on the relatively upper slat 14 as well as engages the top edge 18 of the relatively lower slat 14 as the flange 52 projects through the space between the two slats. The second flange 54 also includes a lip 58 which is adapted to be inserted behind the second edge 20 of a relatively lower slat 14 within the body portion 12 of the shutter 10.

The shutter body is adjusted to size by cutting the shutter at either end. Once the shutter has been cut to a desired length, the end caps are snapped into place. The fin located adjacent the second edge of the front panel of the end cap engages the lip behind edge of the slat to which it is being attached. The tabs located within the channels of the side rails are inset into the notched flanges, thereby securing the end cap in place and flush with the edge of the shutter body. Once the desired position of the mullion has been ascertained, the first flange is placed behind a chosen slat and engages the lip on the second edge of the slat. The second flange of the mullion then snaps in and engages the lip on the second edge of the appropriate slat.

Figure 6:
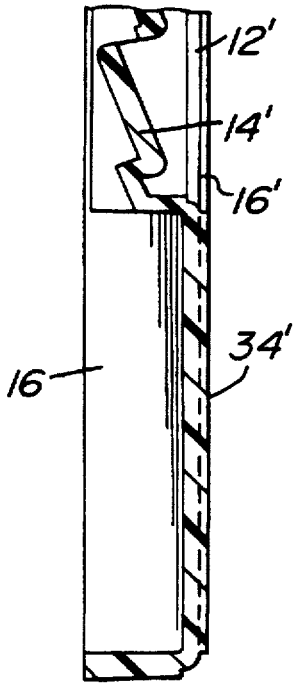
FIG. 6 shows a cross sectional view of an alternate shutter embodiment.

As illustrated in FIG. 6, the shutter body 16' of the present invention may also include a integrally formed end cap 34' at one end thereof. Thus when the body is cut to size, only a single end cap 34' needs to be added to the shutter body 12'.

An alternate embodiment of the shutter of the present invention is illustrated in FIGS. 8–13. In this embodiment, the shutter 110 is generally known as a raised panel type shutter. The primary distinction between a raised panel shutter and a louvered shutter is the inclusion of panels instead of slats. The features of the first embodiment are considered applicable to a raised panel construction as found in this second embodiment. Also, combined raised panel and louvered shutters may incorporate the features of the present invention.

Figure 9:
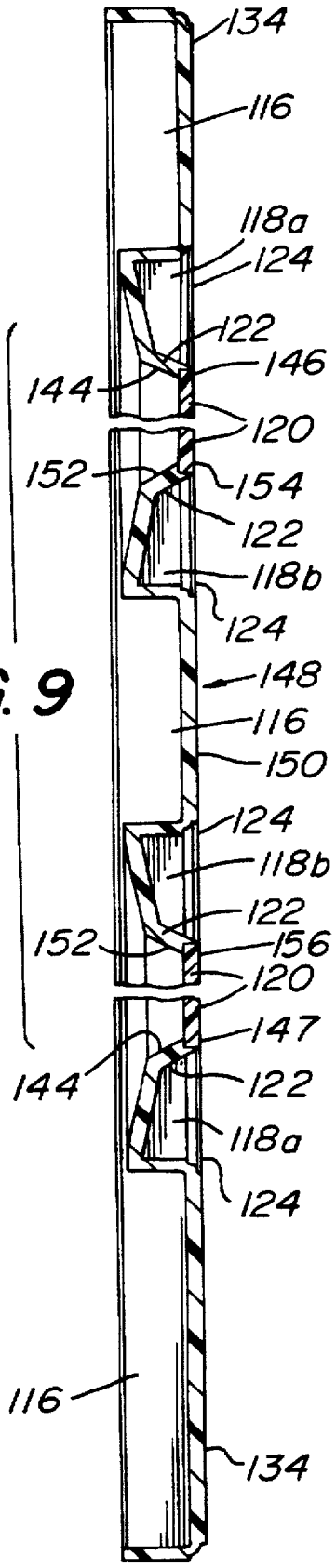
FIG. 9 shows a cross sectional view of the shutter taken along line 9—9 in FIG. 8.

The shutter 110 includes a first raised panel 114 and a second raised panel 115 which are disposed between and generally integrally formed with the two side rails 116. Each panel 114, 115 includes a channel 118 which surrounds its front surface 120. The channel 118 includes an angled lip 22 which extends outwardly toward the edge of the front of the panel surface 120. As illustrated in FIG. 9, the front surfaces 120 of the panels 114, 115 are generally within the same plane as the side rails 116. The channel 118 surrounding the panel surface 120 creates the raised panel effect. However, the panel surface may be sculptured or positioned above or below the plane of the side rails if desired.

As shown in FIGS. 10 and 11, the side rails 116 comprise a front wall 124, a side wall 126 and an inner wall 128. A channel 130 is formed behind the front wall 124. Within the channel 130 is formed a series of tabs 132 which connect the front wall 124 to the outer wall 126. An inner strut 127 is also provided within the channel 130. The tabs 132 and struts 127 serve to stiffen the structure and to resist bowing within the main body of the shutter 110.

As shown in FIGS. 8–13, end caps 134 are provided on each end of the shutter body 112. The end caps 134 include an end wall 136 having flanges 137 projecting inwardly therefrom into the channel 130 of the side rails 116. The end caps 34 further include a front panel 138 having a first edge 140 which is integrally formed with or attached to the end wall 136. A second edge 142 is formed at the opposite end of the front panel 138 from the first edge 140. Upon assembly, the front panel 138 is generally planer with the front wall 124 of the side rails 116 and with the panel surfaces 120. The first edge 140 defines the transition between the front panel 138 and the end wall 136, which forms the top and bottom edges of the shutter 110 upon assembly. The second or inward edge 142 forms the transition from the front panel 138 to the channel **118*a* which as illustrated is formed as part of the end cap 134**.

The flanges 137 which project from the end walls 136 in the same direction as the front panel 138. Upon assembly, the flanges 137 are engaged within the channel 130. The flanges 137 are positioned 136 such that they are in contact with the inside of the front wall 124. In final assembly, the tabs 137 are welded to the side rails by ultrasonics, a thermal welder, or the like. The preferred position of the weld is identified by numeral 129 in FIGS. 11 and 12.

When the end caps 134 are attached to the shutter body 112, the front panel 138 extends between and is planer with the opposing side rails 116 adjacent the ends of the shutter 110. In addition, the channel portion **118*a* meshes with the vertical channel 118 adjacent the front panel surface 120. The projected edge 144 of the channel 118*a* forms a notch which matingly engages the top edge 146 of the front surface 120 of the top front panel 114 or the bottom edge 147 of the front surface 120 of the bottom front panel 115 and locks the end cap 134** in place.

Figure 13:
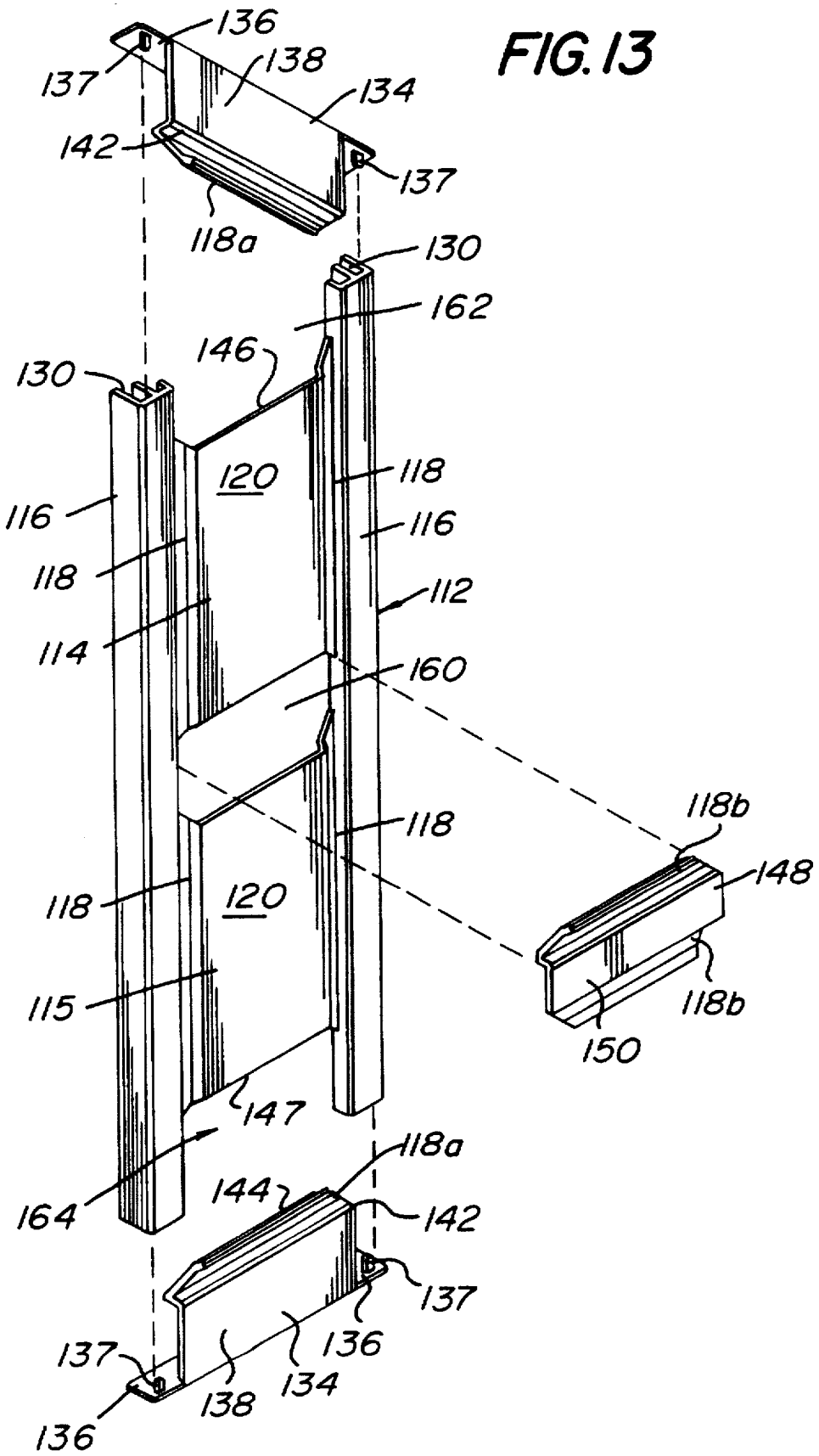
FIG. 13 shows an exploded perspective view of the shutter of FIG. 8.

As particularly shown in FIGS. 9 and 13, a separable mullion 148 is provided having a front wall 150 and top and bottom channel members **118*b*. The mullion 148 fits within an opening 160 formed within the center of the shutter body 112. The mullion 148 is located between the respective front panel surfaces 120 of the two raised panels 114, 115. The channel members 118*b* are preferably formed similar to the channels 118 on the shutter body 112 and similar the channel projections 118*a* on the end caps 134. The channel projections 118*b* include notches 152 which matingly engage the bottom edge 154 of the upper panel 114 and the top edge 156 of the lower panel 115 to secure the mullion 148** in place.

For assembly, the raised panel shutter body 112 is adjusted to size by cutting the shutter at either end. The center of the shutter body 112 is also cut to form opening 160. The cut away portion at one end (such as the top cut away 162. FIG. 13) may be formed as part of the molding process of the shutter body 112 or may be formed by removal of a portion of the vertical channel 118 and front panel surface 120 between the two side rails 116. Once the shutter body 112 is cut to length, the opposite end 129 may be provided with a similar cut away 164. The end caps 134 are then fit into place within the openings 162 and 164 and the flanges 137 are welded to the side rails 116. The mullion 148 is also placed within the central opening 160 with the notches 152 matingly engaging the inside edges of panel 114 and 115.

It should be noted that the raised panel embodiment may also be constructed using end caps having flanges (such as flanges 37) with notches therein that engage the tabs 132 on the side rails as discussed above. Similarly, the shutter body 112 may be constructed with one end having a integrally formed end cap. Thus, the sizing and assembly of the shutter will require only the provision of a central opening 160 and the cutout at the opposite end for a second end cap. Further, this raised panel type shutter may also be provided with multiple mullions between the top and bottom ends. A separate opening would be required for each mullion.

In FIGS. 14–18, there is shown a further embodiment of the invention. As shown in FIG. 14, the shutter 210 includes a series of slats 214 which are angled from a rearward first edge 218 to a forward second edge 220. An opening is defined between adjacent slats 214. The forward or second edge 220 includes a lip 222 which extends toward the rear of the shutter 210. The side rails 216 comprise a front wall 224, a side wall 226 and an inner wall 228 and define a channel 230 behind the front wall 224. The channel 230 includes a strut 227 between the inner wall 228 and outer wall 226 and a series of tabs 232 which connect the inner surfaces of the outer wall 226 and the front wall 224.

End caps 234 are provided on each end of the shutter body 212. The end caps 234 include an end wall 236 having flanges 237 projecting therefrom. The end caps 234 further include a front panel 238 including a first edge 240 which is integrally formed with or attached to the end wall 236. A second edge 242 is formed at the opposite end of the front panel 238.

As illustrated, the top end cap 234 has a second edge 242*a* which includes a curvature or crown. An inwardly projecting fin 244 is provided on the end of the second edge 242 and is adapted to contact the front surface of a slat 214. The top end cap 234*a* also included a hook 246 that projects from the rear surface of the front panel 238 of the end cap 234 so as to engage the bottom edge 222 of a slat 214. The hook 246 engages behind lip 222 and is forward of the top edge 218 of the relatively lower slat 214 to secure the end cap 234*a* to the front of the shutter body 212. As shown in FIG. 15, the hook 246 is discontinuous along the rear surface of the front panel 238.

Upon attachment of the top end cap 234*a*, the front panel 238 covers a plurality of slats 214 adjacent the top end of the shutter 10, the end wall 236 is substantially flush with the top end of the shutter body 212, and the front panel 238 lies substantially flush with the front surface of front wall 224.

The bottom end cap 234 as illustrated in cross section in FIG. 15 is similar to that shown in FIGS. 1–5 and 7. A fin 244*a* projects inwardly and upwardly from the second edge 242. The fin 244*a* has a pointed projection on its end that engages the lip 222 on the inside forward edge 220 of the slat 214 and also engages the top edge 218 of the relatively lower slat 214 to secure the end cap 234 to the front surface of the shutter body 212. Alternatively, one of the end caps may be formed integral with the shutter body as illustrated in FIG. 6.

In the shutter 210 as illustrated, the end caps 234 are secured to the shutter body 212 by means of welding 229 tabs 237 to the front wall 224 of the side rail 216. However, the alternate attachment by means of the flanges having a notch for mating engagement with the channel tabs of the side rail may also be utilized. Other similar means of securing the end wall 236 to the shutter body 212 are contemplated.

A mullion 248 is also provided at the center of the shutter body 212. The mullion 248 includes a front wall 250 and first and second rearwardly projecting flanges 252, 254. The upper or first flange 252 has a fin 256 similar to fin 244*a* as shown on the lower end cap 234. The fin 256 is adapted to be inserted behind and engaged by the lip 222 on the forward edge 220 of one of the slats 214 and behind the top edge 218 of the relatively lower slat 214. The second or bottom flange 254 includes a hook 258, which is adapted to be inserted behind and to engage lip 222 on the rear of the slat 214. The hook 258 is contemplated to be similar to the hook 246 included on the upper end cap 234*a*.

Although the embodiment of the shutter 210 as illustrated includes a specific arrangement for the hooks and fins, any combination of same may be utilized for attaching the end caps and the mullion. Similar instrumentalities may also be utilized.

The shutters of present invention may be custom made to specification prior to shipping, or may be produced by the manufacturer in predetermined sizes. Initially, the components of the shutter, including the shutter body, first end cap, second end cap, and mullion, are molded and placed in inventory. Once a custom order or a stock inventory order for the shutter is received, the appropriate width and style components are selected for producing the desired pair of shutters. The shutter body is then cut to the desired length. When a cut is made to accept the first end cap, the top cut will preferably fall in an opening between two adjacent slats. When a second end cap is used, the cut will preferably fall in the middle of one of the slats. Once the appropriate cuts are made and the shutter is correctly sized, the shutter pieces are assembled, as described above. A similar procedure is followed for the welded embodiment of the shutter.

For the embodiment having a raised panel disposed between the side rails, the components for the shutter will include a shutter body having a continuous raised panel, end caps, and a mullion. Once the specifications for the shutter are received, the shutter body is cut to the appropriate length. The panel is then cut, preferably using blanking dies, to provide a first and second panels. Also, a cut is made for the center opening. The end caps and mullion are then snapped into place, and the weld is applied to the flanges.

The present invention may be embodied in other specific forms without departing from the spirit or essential attributes thereof and, accordingly, reference should be made to the appended claims, rather than to the foregoing specification, as indicating the scope of the invention.

What is claimed is:

1. A shutter assembly, comprising:

a body portion, comprising two vertical side rails, each side rail having a front surface, an outer wall, and an inner, the outer wall having a plurality of tabs extending horizontally within the channel formed by the side rail, and a plurality of horizontal slats disposed between and formed integrally with the side rails, each slat having a rearward first edge and a forward second edge, the second edge having a rearwardly extending lip;

a first and second end cap secured to each end of the shutter body, the end caps comprising an end wall overlying the end of shutter body, a front panel attached to the end wall and a fin engaging the rearwardly extending lip of a horizontal slat on the shutter body, and end wall flanges projecting from the end wall and secured within the channels of the side rails; and a mullion comprising
a front surface, and
one or more mullion flanges engaging a rearwardly extending lip on a horizontal slat within the center of the shutter body and spaced from the end caps on each end of the shutter body.

2. A shutter assembly, comprising:

a body portion, comprising
a pair of vertical side rails, and
a plurality of horizontal slats disposed between and integrally formed with the side rails;

a first end cap secured to one end of the shutter body, the first end cap comprising
an end wall overlying the end of the shutter body, and
a front panel, the front panel extending from the end wall and positioned generally planer with the side rails, and an edge of the front panel opposite the end wall having means for releasably attaching at least a portion of the first end cap to one of the slats on the shutter body; and a mullion comprising
a front surface,
a first flange and a second flange extending transversely from the same side of the front surface, the flanges having means for releasably attaching the mullion to the slats on the shutter body.

3. The shutter assembly according to claim 2, wherein a second end cap is provided on the opposite end of the shutter body from the first end cap.

4. The shutter assembly according to claim 3, wherein the second end cap is integrally formed with the shutter body.

5. The shutter assembly according to claim 2, wherein the side rails further comprise a front wall, an outer wall and an inner wall, which define a longitudinal channel.

6. The shutter assembly according to claim 5, wherein a longitudinal strut is provided within the channels of the side rails.

7. The shutter assembly according to claim 6, wherein the strut is integrally formed with and runs lengthwise along the rear of the shutter body for stiffening the shutter.

8. The shutter assembly according to claim 6, further comprising a plurality of tabs extending horizontally within the channel formed in the side rails, the tabs connecting between the front wall and the outer wall.

9. The shutter assembly according to claim 5, wherein each slat further comprises a rearward first edge and a forward second edge, the second edge having a rearwardly extending lip engaging the releasably attaching means on the first end cap and the mullion.

10. The shutter assembly according to claim 2, wherein the end cap further comprises flanges projecting from the end wall, each projecting flange extending within channels formed within the side rails, the projecting flanges positioned adjacent the first wall of the side rails.

11. The shutter assembly according to claim 10, wherein the projecting flanges matingly engage tabs formed within the channels in the side rails.

12. The shutter assembly according to claim 10, wherein the projecting flanges are welded to the side rails.

13. A shutter assembly, comprising:

a. a body portion, comprising:
i. a pair of parallel side rails, and
ii. raised panel means disposed between and integrally formed with the side rails, the raised panel means provided with an opening therein to define upper and lower panels;

b. a first end cap secured to one end of the body, the first end cap comprising
i. an end wall overlying the end of the opposing side rails and extending therebetween, and
ii. a front panel, the front panel formed integral with and substantially perpendicular to the end wall, an edge of the front panel opposite the end wall having a mating surface for releasably attaching to the raised panel means of the shutter body; and c. a mullion mounted within the opening within the raised panel means, the mullion comprising
i. a front surface extending between the opposing side rails, and
ii. a first flange and a second flange extending transversely from one side of the front surface, the first and second flanges having mating elements thereon for releasably attaching the mullion within the opening in the raised panel means.

14. The shutter assembly according to claim 13, further comprising a second end cap provided at the opposite end of the shutter body from the first end cap.

15. The shutter assembly according to claim 14, wherein the second end cap is integrally formed with the shutter body.

16. The shutter assembly according to claim 13, wherein each end cap further comprises flanges projecting from a face of the end wall, each projecting flange extending into and mating with the side rails.

17. The shutter assembly according to claim 13, wherein each end cap further comprises flanges projecting from a face of the end wall, each projecting flange being welded to the side rails of the shutter body.

18. The shutter assembly according to claim 13, wherein the mullion mating elements comprise a notched groove on the flanges engaging the edges of the raised panel means formed on opposite sides of the opening.

19. The shutter assembly according to claim 13, wherein the side rails define an open channel on one side thereof and wherein the side rails include a plurality of tabs extending horizontally within the channels.

20. The shutter assembly according to claim 19, wherein each end cap further comprises projecting flanges on the end wall, the projecting flanges extending into the channel within the side rails and matingly engaging at least one of the tabs therein.

* * * * *